US006251196B1

(12) United States Patent
Nishiuchi et al.

(10) Patent No.: US 6,251,196 B1
(45) Date of Patent: Jun. 26, 2001

(54) PROCESS FOR PRODUCING FE-B-R BASED PERMANENT MAGNET HAVING A CORROSION-RESISTANT FILM

(75) Inventors: Takeshi Nishiuchi, Osaka; Kohshi Yoshimura, Hyogo; Fumiaki Kikui, Osaka, all of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/383,274

(22) Filed: Aug. 26, 1999

(30) Foreign Application Priority Data

| | | |
|---|---|---|
| Aug. 31, 1998 | (JP) | 10-262476 |
| Oct. 1, 1998 | (JP) | 10-279507 |
| Oct. 8, 1998 | (JP) | 10-286628 |
| Oct. 26, 1998 | (JP) | 10-303731 |
| Dec. 9, 1998 | (JP) | 10-349915 |

(51) Int. Cl.[7] ..... C23C 8/80

(52) U.S. Cl. ..... 148/277; 148/101; 148/284; 427/11; 427/132; 427/347; 427/419.2

(58) Field of Search ..... 427/11, 127, 132, 427/226, 347, 367, 383.7, 397.7, 419.2; 148/101, 247, 277, 284, 285

(56) References Cited

U.S. PATENT DOCUMENTS 5,505,990 * 4/1996 Sagawa et al. ..... 427/184

FOREIGN PATENT DOCUMENTS

| | | | |
|---|---|---|---|
| 0502475A2 | | 9/1992 | (EP) . |
| 62-149108 | | 7/1987 | (JP) . |
| 406140226 | * | 5/1994 | (JP) . |
| 07230906 | | 8/1995 | (JP) . |
| 07302705 | | 11/1995 | (JP) . |
| 09289108 | | 11/1997 | (JP) . |

OTHER PUBLICATIONS

European Search Report dated Apr. 17, 2000.

* cited by examiner

*Primary Examiner*—John Sheehan
*Assistant Examiner*—Andrew L. Oltmans
(74) *Attorney, Agent, or Firm*—Armstrong, Westerman, Hattori, McLeland & Naughton, LLP

(57) ABSTRACT

An Fe—B—R based permanent magnet and metal pieces are placed into a treating vessel, where they are vibrated and/or agitated, whereby a metal film is formed on the surface of the magnet. A sol solution produced by the hydrolytic reaction and the polymerizing reaction of a metal compound which is a starting material for a metal oxide film is applied to the metal film and subjected to a heat treatment to form a metal oxide film. Therefore, it is possible to form, on the surface of the magnet, a corrosion-resistant film which can be produced easily and at a low cost without carrying-out of a plating treatment or a treatment using hexa-valent chromium and which has an excellent adhesion to the surface of the magnet and can exhibit a stable high magnetic characteristic which cannot be degraded even if the magnet is left to stand for a long period of time under high-temperature and high-humidity conditions of a temperature of 80° C. and a relative humidity of 90%. Thus, it is possible to provide an Fe—B—R based permanent magnet having an excellent corrosion resistance.

9 Claims, No Drawings

PROCESS FOR PRODUCING FE-B-R BASED PERMANENT MAGNET HAVING A CORROSION-RESISTANT FILM

BACKGROUND OF THE INVENTION

1. Field of the Invention

The present invention relates to a process for producing an Fe—B—R based permanent magnet having an excellent corrosion-resistant film. More particularly the present invention relates to a process for producing an Fe—B—R based permanent magnet which has, on its surface, an excellent corrosion-resistant film having an excellent adhesion to the surface of the magnet and capable of being formed easily and at a low cost without carrying-out of a plating treatment and a treatment using hexa-valent chromium, and which can exhibit a stable high magnetic characteristic that cannot be degraded even if the magnet is left to stand under high-temperature and high-humidity conditions of a temperature of 80° C. and a relative humidity of 90%.

2. Description of the Related Art

An Fe—B—R based permanent magnet, of which an Fe—B—Nd based permanent magnet is representative, is practically used in various applications, because it is produced of an inexpensive material rich in natural resources and has a high magnetic characteristic.

However, the Fe—B—R based permanent magnet is liable to be corroded by oxidation in the atmosphere, because it contains highly reactive R and Fe. When the Fe—B—R based permanent magnet is used without being subjected to any treatment, the corrosion of the magnet is advanced from its surface due to the presence of a small amount of acid, alkali and/or water to produce rust, thereby bringing about the degradation and dispersion of the magnetic characteristic. Further, when the magnet having the rust produced therein is assembled into a device such as a magnetic circuit, there is a possibility that the rust is scattered to pollute surrounding parts or components.

There is an already proposed magnet which has a corrosion-resistant metal-plated film on its surface, which is formed by a wet plating process such as an electroless plating process and an electroplating process in order to improve the corrosion resistance of the Fe—B—R based permanent magnet with the above-described point in view (see Japanese Patent Publication No. 3-74012). In this process, however, an acidic or alkaline solution used in a pretreatment prior to the plating treatment may remain in pores in the magnet, whereby the magnet may be corroded with the passage of time in some cases. In addition, the magnet is pooi in resistance to chemicals and for this reason, the surface of the magnet may be corroded during the plating treatment. Further, even if the metal-plated film is formed on the surface of the magnet, as described above, if the magnet is subjected to a corrosion test under conditions of a temperature of 60° C. and a relative humidity of 90%, the magnetic characteristic of the magnet may be degraded by 10% or more from an initial value after lapse of 100 hours.

There is also a conventionally proposed process in which a corrosion-resistant film such as a phosphate film or a chromate film is formed on the surface of an Fe—B—R based permanent magnet (see Japanese Patent Publication No. 4-22008). The film formed in this process is excellent in adhesion to the surface of the magnet, but if it is subjected to a corrosion test under conditions of a temperature of 60° C. and a relative humidity of 90%, the magnetic characteristic of the magnet may be degraded by 10% or more from an initial value after lapse of 300 hours.

In a process conventionally proposed in order to improve the corrosion resistance of the Fe—B—R based permanent magnet, i.e., in a so-called aluminum-chromate treating process (see Japanese Patent Publication No. 6-66173), a chromate treatment is carried out after formation of an aluminum film by a vapor deposition process. This process remarkably improves the corrosion resistance of the magnet. However, the chromate treatment used in this process uses hexa-valent chromium which is undesirable for the environment and for this reason, a waste-liquid treating process is complicated. It is feared that a film formed in this process influences a human body during handling of the magnet, because it contains just a small amount of hexa-valent chromium.

On the other hand, there is a conventionally proposed process in which a primary coat layer is formed of a metal used as a main component on the surface of an Fe—B—R based permanent magnet and a glass layer is formed on the surface of the primary coat layer (see Japanese Patent Application Laid-open No. 1-165105). If the primary coat layer is formed using a wet plating, the magnet may be corroded with the passage of time, as described above. For example, if the primary coat layer is formed by a vapor deposition process such as a vacuum evaporation process, it is possible to provide a magnet free of such a problem and having an excellent corrosion resistance. However, to conduct the vapor deposition process, a large-sized device is required and moreover, this device is expensive. A cleaning treatment for the surface of the magnet is required as a pretreatment, and to form the primary coat layer formed of an easily oxidized metal used as a main component such as aluminum, tin, zinc and the like, an extremely high vacuum degree is required. For this reason, an evacuating treatment for a long period of time is required, and thus, the complication of the producing process and the prolongation of the time required for the producing process cannot be avoided.

SUMMARY OF THE INVENTION

Accordingly, it is an object of the present invention to provide a process for producing an Fe—B—R based permanent magnet which has, on its surface, an excellent corrosion-resistant film having an excellent adhesion to the surface of the magnet and capable of being formed easily and at a low cost without carrying-out of a plating treatment and a treatment using hexa-valent chromium, and which can exhibit a stable high magnetic characteristic that cannot be degraded even if the magnet is left to stand under high-temperature and high-humidity conditions of a temperature of 80° C. and a relative humidity of 90%.

The present inventors have made various zealous studies with the above points in view and as a result, they have found that when an Fe—B—R based permanent magnet and metal pieces are placed into a treating vessel and vibrated in the treating vessel and/or agitated, a fine metal powder produced from the metal piece can be deposited to the surface of the magnet to form a film; that when a metal oxide film is formed on the metal film by a sol-gel process, the metal oxide film is firmly closely adhered to the surface of the metal film on the magnet to enhance the corrosion resistance of the magnet; and that the influence to the human body and the environment can be remarkably reduced by employing the sol-gel process and moreover, such producing process is very simple.

The present invention has been accomplished based on such knowledge. To achieve the above object, according to a first aspect and feature of the present invention, there is provided a process for producing a permanent magnet having a metal oxide film on the surface thereof with a metal film interposed therebetween, comprising the steps of placing an Fe—B—R based permanent magnet and metal pieces into a treating vessel, where they are vibrated and/or agitated, thereby forming a metal film on the surface of the magnet; applying, to the surface of the metal film, a sol solution produced by the hydrolytic reaction and the polymerizing reaction of a metal compound which is a starting material for a metal oxide film; and subjecting the applied sol solution to a heat treatment to form a metal oxide film.

According to a second aspect and feature of the present invention, in addition to the first feature, the metal piece is used to form a metal film made of at least one metal component selected from the group consisting of aluminum, tin and zinc.

According to a third aspect and feature of the present invention, in addition to the first feature, the metal piece is of an acicular or columnar shape with a size (length) of 0.05 mm to 10 mm.

According to a fourth aspect and feature of the present invention, in addition to the first feature, the thickness of the metal film is in a range of 0.01 $\mu$m to 1 $\mu$m.

According to a fifth aspect and feature of the present invention, in addition to the first feature, the sol solution is used to form a metal oxide film made of at least one metal oxide component selected from the group consisting of aluminum (Al) oxide, silicon (Si) oxide, zirconium (Zr) oxide and titanium (Ti) oxide.

According to a sixth aspect and feature of the present invention, in addition to the first feature, the sol solution is used to form a metal oxide film containing the same metal component as the metal component of the metal film.

According to a seventh aspect and feature of the present invention, in addition to the first feature, the thickness of the metal oxide film is in a range of 0.01 $\mu$m to 10 $\mu$m.

According to an eighth aspect and feature of the present invention, in addition to the first feature, the content of carbon (C) contained in the metal oxide film is in a range of 50 ppm to 1,000 ppm.

According to a ninth aspect and feature of the present invention, in addition to the first feature, the metal oxide film is formed of a metal oxide essentially comprising an amorphous phase.

With the process according to the present invention, it is possible to form, on the surface of the magnet, an excellent corrosion-resistant film which can be produced easily and at a low cost without carrying-out of a plating treatment or a treatment using hexa-valent chromium and which has an excellent adhesion to the surface of the magnet, and the magnet can exhibit a stable high magnetic characteristic that cannot be deteriorated even if the magnet is left to stand for a long period of time under high-temperature and high-humidity conditions of a temperature of 80° C. and a relative humidity of 90%. Thus, it is possible to provide an Fe—B—R based permanent magnet having an excellent corrosion resistance.

DETAILED DESCRIPTION OF THE INVENTION

A process for forming a metal film on the surface of a magnet will now be described which comprises placing an Fe—B—R based permanent magnet and metal pieces into a treating vessel, where they are vibrated and/or agitated.

A metal piece corresponding to a metal component for a desired metal film may be used. One example of such a metal piece is a metal piece made of at least one metal component selected from the group consisting of aluminum, tin, zinc, copper, iron, nickel, cobalt and titanium. Those of these metal components which can form a metal film efficiently on a sintered magnet are aluminum, tin and zinc. The metal piece may be made of a single metal component or an alloy. A metal film made of a plurality of metal components may be formed using a plurality of metal pieces of different metal components.

Metal pieces having various shapes such as an acicular (wire-like) shape, a columnar shape and a massive shape can be used, but from the viewpoint for efficiently producing a fine metal powder which is a starting material for forming the metal film, it is desirable that an acicular or columnar metal piece having a sharp end is used.

From the viewpoint for efficiently producing a fine metal powder which is a starting material for forming the metal film, it is desirable that the size (length) of the metal piece is in a range of 0.05 mm to 10 mm, preferably, in a range of 0.3 mm to 5 mm, more preferably, in a range of 0.5 mm to 3 mm. Metal pieces having the same shape and the same size may be used, and metal pieces having different shapes and different sizes may be used in combination.

It is desirable that the vibration and/or agitation of the magnet and the metal pieces are conducted in a dry manner, in consideration of that the magnet and the metal piece are liable to be oxidized and corroded. The vibration and/or agitation of the magnet and the metal pieces can be conducted in the atmosphere and at ambient temperature. The treating vessel used in the present invention does not require a complicated structure, and for example, may be a treating chamber in a barrel finishing machine. The barrel finishing machine may be a known device of a rotary type, a vibrating type or a centrifugal type. In the case of the rotary type, it is desirable that the speed of rotations is set in a range of 20 rpm to 50 rpm. In the case of the vibrating type, it is desirable that the vibration frequency is set in a range of 50 Hz to 100 Hz, and the amplitude by vibration is set in a range of 3 mm to 10 mm. In the case of the centrifugal type, it is desirable that the number of rotations is set in a range of 70 rpm to 200 rpm.

It is desirable that the amount of the magnet and the metal pieces placed into the treating vessel is in a range of 20% by volume to 90% by volume of the internal volume of the treating vessel. If the amount is lower than 20% by volume, it is too small and is not of practical use. If the amount exceeds 90% by volume, there is a possibility that a metal film cannot be formed efficiently. The amount ratio of the magnet to the metal pieces is desirable to be 3 or less in terms of a volume ratio (magnet/metal pieces). If the volume ratio exceeds 3, there is a possibility that a lot of time is required and hence, the volume ratio exceeding 3 is not of practical use. The treating time depends on the treatment amount and is usually in a range of 1 hour to 10 hours.

With the above-described process, a fine metal powder produced from the metal piece is deposited to the surface of the magnet to form a metal film. The phenomenon of deposition of the fine metal powder to the surface of the magnet is considered to be a peculiar mechanochemical reaction. The fine metal powder is firmly deposited to the surface of the magnet, and the formed metal film shows an excellent corrosion resistance. From the viewpoint for ensuring a satisfactory corrosion resistance, it is desirable that the thickness of the metal film is equal to or larger than 0.01 $\mu$m. The upper limit for the film thickness is particularly not limited. However, a lot of time is required for forming a metal film having a thickness exceeding 1 μm and hence, this process is suitable for forming a metal film having a thickness of 1 μm or less.

The adhesion between the surface of the magnet and the metal film can be enhanced by subjecting the metal film formed on the surface of the magnet by the above-described process to a heat treatment. The heat treatment may be carried out at this stage, but a similar effect can be provided even by a heat treatment for forming a metal oxide film which will be described hereinafter. It is desirable that the temperature for the heat treatment is equal to or lower than 500° C., because there is a possibility that if the temperature exceeds 500° C., the degradation of the magnetic characteristic may be brought about, or the metal film may be molten.

A procedure for applying a sol solution produced by the hydrolytic reaction and the polymerizing reaction of a metal compound, which is a starting material for a metal oxide film, to the surface of the formed metal film and subjecting the applied sol solution to a heat treatment to form a metal oxide film, will be described below.

The metal oxide film may be a film formed of a single metal oxide component, or a composite film formed of a plurality of metal oxide components. The metal oxide component may be, for example, at least one selected from the group consisting of aluminum (Al) oxide, silicon (Si) oxide, zirconium (Zr) oxide and titanium (Ti) oxide.

Among the films formed of the single metal oxide, the silicon oxide film ($SiO_x$ film: 021 $x \leqq 2$) can be formed at a low temperature, as compared with a case where a film of another metal oxide component, because the sol solution for forming the film is stable, as compared with a sol solution for forming another metal oxide film and hence, this silicon oxide film is advantageous in respect of that the influence to the magnetic characteristic of the magnet can be reduced. The zirconium oxide film ($ZrO_x$ film:$0<x \leqq 2$) is advantageous in respect of that it is excellent not only in corrosion resistance but also in alkali resistance.

If the metal oxide film is one containing the same metal component as the metal component of a metal film which is a primary coat layer (e.g., when an aluminum oxide film ($Al_2O_x$ film:$0<x \leqq 3$) is formed on an aluminum film), this film is advantageous in respect of that the adhesion at the interface between the metal film and the metal oxide film is firmer.

Examples of the composite film formed of a plurality of metal oxide components are a Si—Al composite film ($SiO_x.Al_2O_y$ film:$0<x \leqq 2$ and $0<y \leqq 3$), a Si—Zr composite film ($SiO_x.ZrO_y$ film:$0<x \leqq 2$ and $0<y \leqq 2$), and a Si—Ti composite film ($SiO_x.TiO_y$ film:$0<x \leqq 2$ and $0<y \leqq 2$). The composite film containing a Si oxide component is advantageous in respect of that the sol solution is relatively stable, and that such film can be formed at a relatively low temperature and hence, the influence on the magnetic characteristic of the magnet can be reduced. The composite film containing a Zr oxide component is advantageous in respect of that it is excellent in alkali resistance.

If the metal oxide film is a composite film containing the same metal component as the metal component of the metal film as the primary coat layer (e.g., when a Si—Al composite oxide film is formed on an aluminum film, or when a Si—Ti composite oxide film is formed on a titanium film), this composite film is advantageous in respect of that the adhesion at the interface between the metal film and the composite film is firmer.

The sol solution used in the sol-gel process is a solution made by preparing a metal compound which is a source for forming a metal oxide film, a catalyst, a stabilizer and water in an organic solvent to produce a colloid by the hydrolytic reaction and the polymerizing reaction, so that the colloid is dispersed in the solution.

Examples of the metal compound as the source for forming the metal oxide film, which may be used, are a metal alkoxide (which may be an alkoxide with at least one alkoxyl group substituted with an alkyl group such as methyl group and ethyl group or with a phenyl group or the like) such as methoxide, ethoxide, propoxide, butoxide; a metal carboxylate such as oxalate, acetate, octylate and stearate; a chelate compound such as metal acetylacetonate; and inorganic salts such as metal nitrate and chloride.

If the stability and cost of the sol solution is taken into consideration, in cases of an aluminum compound used for forming an aluminum oxide film and a zirconium compound used for forming a zirconium oxide film, it is desirable to use an alkoxide having an alkoxyl group containing 3 to 4 carbon atoms such as aluminum and zirconium propoxides and butoxides, a carboxylate such as metal acetate and octylate. In a case of a silicon (Si) compound used for forming a Si oxide film, it is desirable to use an alkoxide having an alkoxyl group containing 1 to 3 carbon atoms such as silicon methoxide, ethoxide and propoxide. In a case of a titanium (Ti) compound used for forming a Ti oxide film, it is desirable to use an alkoxide having an alkoxyl group containing 2 to 4 carbon atoms such as titanium ethoxide, propoxide and butoxide.

To form a composite oxide film, a plurality of metal compounds may be used in the form of a mixture thereof, and a metal composite compound such as a metal composite alkoxide may be used alone or in combination with a metal compound. For example, to form a Si—Al composite oxide film, a Si—Al composite compound such as a Si—Al composite alkoxide having a Si—O—Al bond and alkoxyl groups (some of which may be substituted with an alkyl group such as methyl group and ethyl group or with a phenyl group or the like) containing 1 to 4 carbon atoms may be used. Particular examples of such compound are $(H_3CO)_3$—Si—O—Al—$(OCH_3)_2$ and $(H_5C_2O)_3$—Si—O—Al—$(OC_2H_5)_2$.

When a composite oxide film is to be formed using a plurality of metal compounds, the mixing proportion of each metal compound is particularly not limited, and may be determined in accordance with the proportions of components for a desired composite oxide film.

For example, when a Si—Al composite oxide film is to be formed on an aluminum (Al) film, it is desirable that a Si compound and an Al compound are mixed for use, or a Si compound and a Si—Al composite compound are mixed for use, so that the molar ratio (Al/Si+Al) of aluminum to the total number of moles of silicon (Si) and aluminum (Al) contained in the Si—Al composite oxide film is equal to or larger than 0.001. By mixing such compounds at the above-described molar ratio, the reactivity at the interface with the aluminum film can be enhanced, while maintaining excellent characteristics (the sol solution is stable and the film can be formed at a relative low temperature) in the silicon oxide film. When a heat treatment (which will be described hereinafter) is carried out at 150° C. or lower after application of the sol solution to the surface of the metal film, the molar ratio is desirable to be 0.5 or less. When such a treatment is carried out at 100° C. or lower, the molar ratio is desirable to be 0.2 or less. This is because it is necessary to raise the temperature in the heat treatment, as the proportion of aluminum mixed is increased.

The proportion of metal compound blended to the sol solution is desirable to be in a range of 0.1% by weight to 20% by weight (in terms of the proportion of the metal oxide, e.g., in terms of the proportion of $SiO_2$ in a case of a Si compound, and in terms of the proportion of $SiO_2+Al_2O_3$ in a case of a Si compound+an Al compound). If the proportion is lower than 0.1% by weight, there is a possibility that an excessive cycle of the film forming step is required in order to form a film having a satisfactory thickness. If the proportion exceeds 20% by weight, there is a possibility that the viscosity of the sol solution is increased, thereby making it difficult to form the film.

Acids such as acetic acid, nitric acid and hydrochloric acid may be used alone or in a combination as a catalyst. The appropriate amount of acid(s) added is defined by the hydrogen ion concentration in the prepared sol solution, and it is desirable that the acid(s) is added, so that the pH value of the sol solution is in a range of 2 to 5. If the pH value is smaller than 2, or exceeds 5, there is a possibility that the hydrolytic reaction and the polymerizing reaction cannot be controlled at the time of preparing a sol solution suitable for forming a film.

If required, the stabilizer used to stabilize the sol solution may be selected properly depending on the chemical stability of a metal compound used, but a compound capable of forming a chelate with a metal is preferable such as a β-diketone such as acetylacetone, and a β-keto ester such as ethyl acetoacetate.

The amount of stabilizer mixed is desirable to be equal to or smaller than 2 in terms of a molar ratio (stabilizer/metal compound) when the β-diketone is used. If the molar ratio exceeds 2, there is a possibility that the hydrolytic reaction and the polymerizing reaction to prepare the sol solution may be hindered.

Water may be supplied to the sol solution directly or indirectly by a chemical reaction, e.g., by utilizing water produced by an esterifying reaction with a carboxylic acid, when an alcohol is used as a solvent, or by utilizing water vapor in the atmosphere. When water is supplied directly or indirectly to the sol solution, the molar ratio of water/metal compound is desirable to be equal to or smaller than 100. If the molar ratio exceeds 100, there is a possibility that the stability of the sol solution is influenced.

The organic solvent is not limited, and may be any solvent which is capable of homogeneously dissolving all of a metal compound, a catalyst, a stabilizer and water which are components of the sol solution, so that the produced colloid is dispersed homogeneously in the solution. Examples of the organic solvent which may be used are a lower alcohol such as ethanol; a hydrocarbonic ether alcohol such as ethylene glycol mono-alkyl ether; an acetate of hydrocarbonic ether alcohol such as ethylene glycol mono-alkyl ether acetate; an acetate of lower alcohol such as ethyl acetate; and a ketone such as acetone. From the viewpoints of the safety during treatment and the cost, it is desirable that lower alcohols such as ethanol, isopropyl alcohol and butanol are used alone or in combination.

The viscosity of the sol solution depends on the combination of various components contained in the sol solution, and is desirable to be generally equal to or smaller than 20 cP. If the viscosity exceeds 20 cP, there is a possibility that it is difficult to form a film uniformly, and cracks may be generated during a thermal treatment.

The time and temperature for preparing the sol solution depend on the combination of various components contained in the sol solution. Usually, the preparing time is in a range of 1 minute to 72 hours, and the preparing temperature is in a range of 0° C. to 100° C.

Examples of the method for applying the sol solution to the surface of the metal film, which may be used, are a dip coating process, a spraying process and a spin coating process.

After application of the sol solution to the surface of the metal film, the applied sol solution is subjected to a heat treatment. The heating temperature required may be a level enough to evaporate at least the organic solvent. For example, when the ethanol is used as the organic solvent, the minimum temperature is 80° C. which is a boiling point of the ethanol. On the other hand, when a sintered magnet is used, if the heating temperature exceeds 500° C., there is a possibility that the degradation of the magnetic characteristic of the magnet is caused, or the metal film is molten. Therefore, the heating temperature is desirable to be in a range of 80° C. to 500° C., and more preferably, is in a range of 80° C. to 250° C. from the viewpoint for preventing the generation of cracks during cooling after the heat treatment to the utmost. When a bonded magnet is used, the temperature condition for the heat treatment must be set in consideration of the heat-resistant temperature of a resin used. For example, when a bonded magnet made using an epoxy resin or a polyamide resin is used, the heating temperature is desirable to be in a range of 80° C. to 200° C. in consideration of the heat-resistant temperatures of these resins. Usually, the heating time is in a range of 1 minute to 1 hour.

According to the above-described process, a metal oxide film essentially comprising an amorphous phase, which is excellent in corrosion resistance, can be formed. For example, with a Si—Al composite oxide film, the structure thereof includes a large number of Si—O—Si bonds and a large number of Si—O—Al bonds, when in a case of a Si-rich film, and includes a large number of Al—O—Al bonds and a large number of Si—O—Al bonds in a case of an Al-rich film. The proportions of both the components in the film are determined by a proportion of metal compound mixed.

According to the above-described process, the metal oxide film contains carbon (C) due to the metal compound and the stabilizer. The metal oxide film essentially comprising an amorphous phase, which is excellent in corrosion resistance, is produced easily by the containment of carbon, and it is desirable that the carbon (C) content is in a range of 50 ppm to 1,000 ppm (wt/wt). If the C content is smaller than 50 ppm, there is a possibility that cracks are generated in the film. If the C content exceeds 1,000 ppm, there is a possibility that the densification of the film does not occur sufficiently.

The metal oxide film formed by the above-described process has an excellent corrosion resistance, if its thickness is equal to or larger than 0.01 μm. The upper limit for the thickness of the film capable of being formed by the above-described process is not limited, but may be equal to or smaller than 10 μm, desirably, equal to or smaller than 5 μm, more desirably, equal to or smaller than 1 μm, from the viewpoint for need for reduction in size of the magnet itself and the view point for ensuring a durability, when the magnet is assembled into a part whose temperature is varied largely as in a motor for an automobile. It is of course that if required, the application of the sol solution to the surface of the metal film and the subsequent heat treatment may be conducted repeatedly a plurality of times.

A shot peening (a process for modifying the surface by bumping hard particles against the surface) may be carried out as a previous step before the formation of the metal oxide film on the metal film. The metal film can be smoothened by carrying out the shot peening, thereby facilitating the formation of a metal oxide film which is thin, but has an excellent corrosion resistance.

It is desirable that a powder having a hardness equivalent to or more than the hardness of the formed metal film is used for the shot peening. Examples of such powder are spherical hard particles having a Mohs hardness of 3 or more such as steel balls and glass beads. If the average particle size of the powder is smaller than 30 $\mu$m, the pushing force applied to the metal film is smaller and hence, a lot of time is required for the treatment. On the other hand, if the average particle size of the powder exceeds 3,000 $\mu$m, there is a possibility that the smoothness of the surface is too large, and the finished surface is uneven. Therefore, the average particle size of the powder is desirably in a range of 30 $\mu$m to 3,000 $\mu$m, and more desirably in a range of 40 $\mu$m to 2,000 $\mu$m.

The blast pressure in the shot peening is desirable to be in a range of 1.0 kg/cm$^2$ to 5.0 kg/cm$^2$. If the blast pressure is lower than 1.0 kg/cm$^2$, there is a possibility that the pushing force applied to the metal film is smaller and a lot of time is required for the treatment. If the blast pressure exceeds 5.0 kg/cm$^2$, there is a possibility that the pushing force applied to the metal film is ununiform, thereby bringing about the degradation of the smoothness of the surface.

The blast time in the shot peening is desirable to be in a range of 1 minute to 1 hour. If the blast time is shorter than 1 minute, there is a possibility that the uniform treatment of the entire surface cannot be achieved. If the blast time exceeds 1 hour, there is a possibility that the degradation of the smoothness of the surface is brought about.

A rare earth element (R) contained in an Fe—B—R based permanent magnet used in the present invention is desirably at least one element from among Nd, Pr, Dy, Ho, Th and Sm, in addition thereto at least one element from among La, Ce, Gd, Er, Eu, Tm, Yb, Lu and Y.

Usually, one of them (R) suffices, but in practice, a mixture of two or more rare earth elements (misch metal and didymium and the like) may be used for the reason of a procurement convenience.

The content of R in an Fe—B—R based permanent magnet is desirably in a range of 10% by atom to 30% by atom. If the R content is lower than 10% by atom, the crystal structure is the same cubic crystal structure as $\alpha$-Fe and for this reason, a high magnetic characteristic, particularly, a high coercive force (iHc) is not obtained. On the other hand, if the R content exceeds 30% by atom, the content of an R-rich non-magnetic phase is increased, and the residual magnetic flux density (Br) is reduced, whereby a permanent magnet having an excellent characteristic is not produced.

The Fe content is desirably in a range of 65% by atom to 80% by atom. If the Fe content is lower than 65% by atom, the residual magnetic flux density (Br) is reduced. If the Fe content is exceeds 80% by atom, a high coercive force (iHc) is not obtained.

It is possible to improve the temperature characteristic without degradation of the magnetic characteristic of the produced magnet by substituting a portion of Fe with Co. However, if the amount of Co substituted exceeds 20% of Fe, the magnetic characteristic is degraded and hence, such amount is not preferred. The amount of Co substituted in a range of 5% by atom to 15% by atom is desirable for providing a high magnetic flux density, because the residual magnetic flux density (Br) is increased, as compared with a case where a portion of Fe is not substituted.

The B content is desirably in a range of 2% by atom to 28% by atom. If the B content is smaller than 2% by atom, a rhombohedral structure is a main phase, and a high coercive force (iHc) is not obtained. If the B content exceeds 28% by atom, the content of a B-rich non-magnetic phase is increased, and residual magnetic flux density (Br) is reduced, whereby a permanent magnet having an excellent characteristic is not produced.

To improve the manufacture of the magnet and reduce the cost, at least one of 2.0% by weight of P and 2.0% by weight of S may be contained in a total amount of 2.0% by weight or less in the magnet. Further, the corrosion resistance of the magnet can be improved by substituting a portion of B with 30% by weight or less of carbon (C).

Further, the addition of at least one of Al, Ti, V, Cr, Mn, Bi, Nb, Ta, Mo, W, Sb, Ge, Sn, Zr, Ni, Si, Zn, Hf and Ga is effective for improving the coercive force and the rectangularity of a demagnetizing curve and for improving the manufacture and reducing the cost. It is desirable that at least one of these metals is added in an amount within a range satisfying a condition that at least 9 kG of Br is required in order to ensure that the maximum energy product (BH)max is equal to or larger than 20 MGOe.

In addition to R, Fe and B, the Fe—B—R based permanent magnet may contain impurities inevitable for industrial production of the magnet.

The Fe—B—R based permanent magnet used in the present invention has the feature of including a main phase comprising a compound having a tetragonal crystal structure with an average crystal grain size in a range of 1 $\mu$m to 80 $\mu$m, and 1% to 50% by volume of a non-magnetic phase (excluding an oxide phase). The magnet shows iHc$\geqq$1 kOe, Br>4 kG and (BH)max$\geqq$10 MGOe, wherein the maximum value of (BH)max reaches 25 MGOe or more.

A further film may be formed on the metal oxide film of the present invention. By employing such a configuration, it is possible to enhance the characteristic of the metal oxide film and provide further functionability to the metal oxide film.

EXAMPLES

For example, as described in U.S. Pat. No. 4,770,723, a known cast ingot was pulverized and then subjected sequentially to pressing, sintering, heat treatment and surface working, thereby producing a sintered magnet having a size of 23 mm×10 mm×6 mm and a composition of 17Nd-1Pr-75Fe-7B (which will be referred to as "magnet test piece" hereinafter). The magnet test piece was subjected to the following experiment, wherein the thickness of a metal film was measured using a fluorescence X ray thickness-meter, and the thickness of a metal oxide film was measured by observing a broken face of the film by an electron microscope. The content of carbon (C) in the metal oxide film was measured by a glow discharge mass spectrometer. In addition, the structure of the metal oxide film was analyzed using an X ray diffractmeter.

It should be noted that the present invention is not limited to an Fe—B—R based sintered magnet and is also applicable to an Fe—B—R based bonded magnet.

Example 1

150 Magnet test pieces (having an apparent volume of 0.51 and a weight of 1.6 kg) and short columnar aluminum pieces having a diameter of 0.8 mm and a length of 1 mm (and having an apparent volume of 20 l and a weight of 100 kg) were thrown into a treating chamber having a volume of 50 l in a vibrating type barrel finishing machine (the total combined amount was 40% by volume of the internal volume of the treating chamber). They were then subjected to a dry treatment for 5 hours under conditions of vibration frequency of 60 Hz and an amplitude of 1.8 mm, whereby an aluminum film was formed on the surface of the magnet. The formed aluminum film had a thickness of 0.05 μm.

A sol solution was prepared from the following components: an aluminum compound, a catalyst, a stabilizer, an organic solvent and water which are shown in Table 1, at a composition, a viscosity and a pH value which are shown in Table 2. The sol solution was applied to the magnet having the aluminum film at a pulling rate shown in Table 3 by a dip coating process, and then subjected to a heat treatment shown in Table 3 to form an aluminum oxide film on the aluminum film. The formed film ($Al_2O_x$ film:$0<x\leqq 3$) had a thickness of 1 μm. The content of carbon (C) in the film was 450 ppm. The structure of the film was amorphous.

The magnet having the aluminum oxide film on its surface with the aluminum film interposed therebetween was subjected to a corrosion resistance acceleration test by leaving it to stand under high-temperature/high-humidity conditions of a temperature of 80° C. and a relative humidity of 90% for 300 hours. The magnetic characteristics before and after the test and the variation in appearance after the test are shown in Table 4. As a result, it was found that even if the magnet was left to stand under the high-temperature/high-humidity conditions for the long period of time, the magnetic characteristic and the appearance of the magnet were little degraded, and the required corrosion resistance was satisfied sufficiently. The magnet was bonded to a jig made of a cast iron with a modified acrylate-based adhesive (Product No.Hard loc G-55 made by Denki Kagaku Kogyo Kabushiki Kaisha) and left to stand for 24 hours and then subjected to another test, i.e., a compressing-shearing test using an Amsler testing machine to measure a shear bond strength of the magnet, thereby providing an excellent value of 331 kgf/cm$^2$.

Example 2

A sol solution having a composition, a viscosity and a pH value shown in Table 2 was prepared from components: a Si compound, a catalyst, a stabilizer, an organic solvent and water shown in Table 1. The sol solution was applied to the magnet produced in Example 1 and having the aluminum film of 0.05 μm on its surface at a pulling rate shown in Table 3 by a dip coating process and then subjected to a heat treatment shown in Table 3 to form a Si oxide film on the aluminum film. The formed film had a thickness of 0.8 μm ($SiO_x$ film:$0<x\leqq 2$). The amount of carbon in the film was 450 ppm. The structure of the film was amorphous.

The magnet produced by the above-described process and having the Si oxide film on its surface with the aluminum film interposed therebetween was subjected to a corrosion resistance acceleration test under the same conditions as in Example 1. The results are given in Table 4. As a result, it was found that the produced magnet satisfied the required corrosion resistance sufficiently. The magnet was further subjected to another test, i.e., a compressing-shearing test under the same conditions as in Example 1 to measure a shear bond strength of the magnet, thereby providing an excellent value of 274 kgf/cm$^2$.

Example 3

A sol solution having a composition, a viscosity and a pH value shown in Table 2 was prepared from components: a Zr compound, a catalyst, a stabilizer, an organic solvent and water shown in Table 1. The sol solution was applied to the magnet produced in Example 1 and having the aluminum film of 0.05 μm on its surface at a pulling rate shown in Table 3 by a dip coating process and then subjected to a heat treatment shown in Table 3 to form a Zr oxide film on the aluminum film. The formed film had a thickness of 1 μm ($ZrO_x$ film:$0<x\leqq 2$). The amount of carbon in the film was 450 ppm. The structure of the film was amorphous.

The magnet produced by the above-described process and having the Zr oxide film on its surface with the aluminum film interposed therebetween was subjected to a corrosion resistance acceleration test under the same conditions as in Example 1. The results are given in Table 4. As a result, it was found that the produced magnet satisfied the required corrosion resistance sufficiently.

Example 4

A sol solution having a composition, a viscosity and a pH value as shown in Table 2 was prepared from the following components: a Ti compound, a catalyst, a stabilizer, an organic solvent and water as shown in Table 1. The sol solution was applied to the magnet produced in Example 1 and having the aluminum film of 0.05 μm on its surface at a pulling rate shown in Table 3 by a dip coating process and then subjected to a heat treatment shown in Table 3 to form a Ti oxide film on the aluminum film. The formed film had a thickness of 1 μm ($TiO_x$ film:$0<x\leqq 2$). The amount of carbon in the film was 320 ppm. The structure of the film was amorphous.

The magnet produced by the above-described process and having the Ti oxide film on its surface with the aluminum film interposed therebetween was subjected to a corrosion resistance acceleration test under the same conditions as in Example 1. The results are given in Table 4. As a result, it was found that the produced magnet satisfied the required corrosion resistance sufficiently.

TABLE 1

| | Metal compound | Catalyst | Stabilizer | Organic solvent |
|---|---|---|---|---|
| Example 1 | aluminum butoxide | hydrochloric acid | not added | 2-methoxy-ethanol |
| Example 2 | dimetyldiethoxy silane | hydrochloric acid | not added | ethanol |
| Example 3 | zirconium octylate | hydrochloric acid | not added | isopropyl alchohol |
| Example 4 | titanium isopropoxide | nitric acid | not added | ethanol |

TABLE 2

| | Proportion of metal compound (% by weight) | Molar ratio: Catalyst/Metal compound | Molar ratio: Stabilizer/Metal compound | Molar ratio: Water/Metal compound | Viscosity (cP) | pH |
|---|---|---|---|---|---|---|
| Example 1 | 1 (Note.1) | 0.005 | 0 | 0 (Note.5) | 2.0 | 2.4 |
| Example 2 | 1 (Note.2) | 0.005 | 0 | 20 | 1.5 | 2.3 |
| Example 3 | 2 (Note.3) | 0.005 | 0 | 0 (Note.5) | 1.6 | 2.6 |
| Example 4 | 3 (Note.4) | 0.002 | 0 | 1 | 2.1 | 2.1 |

(Note.1) in terms of $Al_2O_3$
(Note.2) in terms of $SiO_2$
(Note.3) in terms of $ZrO_2$ TABLE 2-continued

| | Proportion of metal compound (% by weight) | Molar ratio Catalyst/Metal compound | Stabilizer/Metal compound | Water/Metal compound | Viscosity (cP) | pH |
|---|---|---|---|---|---|---|

(Note.4) in terms of $TiO_2$
(Note.5) utilizing water vapor in the atmosphere

TABLE 3

| | Pulling rate (cm/min) | Heat treatment | Note |
|---|---|---|---|
| Example 1 | 5 | 250° C. × 10 min | Pulling-up and heat treatment were repeated five times |
| Example 2 | 5 | 150° C. × 10 min | Pulling-up and heat treatment were repeated five times |
| Example 3 | 5 | 250° C. × 10 min | Pulling-up and heat treatment were repeated five times |
| Example 4 | 5 | 250° C. × 10 min | Pulling-up and heat treatment were repeated five times |

TABLE 4

| | Before corrosion-resistance test Br (kG) | iHc (kOe) | (BH)max (MGOe) | After corrosion-resistance test Br (kG) | iHc (kOe) | (BH)max (MGOe) | Appearance after test |
|---|---|---|---|---|---|---|---|
| Example 1 | 11.4 | 16.6 | 30.6 | 11.4 | 16.4 | 29.9 | not varied |
| Example 2 | 11.4 | 16.6 | 30.6 | 11.4 | 16.3 | 29.8 | not varied |
| Example 3 | 11.4 | 16.6 | 30.6 | 11.3 | 16.4 | 29.8 | not varied |
| Example 4 | 11.5 | 16.5 | 30.6 | 11.3 | 16.3 | 29.7 | not varied |
| Com. Example 1 | 11.3 | 16.7 | 30.5 | 10.4 | 15.6 | 27.3 | locally rusted |
| Com. Example 2 | 11.4 | 16.6 | 30.6 | 10.0 | 15.2 | 26.5 | hardly rusted on entire surface |

Com. = Comparative

Comparative Example 1

The magnet test piece was degreased, dipped into an acid and immersed into a treating solution comprising 4.6 g/l of zinc and 17.8 g/l of phosphate having a temperature 70° C., whereby a phosphate film having a thickness of 1 μm was formed on the surface of the magnet. The produced magnet was subjected to a corrosion resistance acceleration test under the same conditions as in Example 1. The results are given in Table 4. As a result, the produced magnet was degraded in magnetic characteristic and rusted.

Comparative Example 2

The magnet test piece was subjected to a corrosion resistance acceleration test under the same conditions as in Example 1. The results are given in Table 4. As a result, the magnet test piece was degraded in magnetic characteristic and rusted.

Example 5

A sol solution was prepared from the following components: a Si compound, an aluminum compound, a catalyst, a stabilizer, an organic solvent and water which are shown in Table 5, at a composition, a viscosity and a pH value which are shown in Table 6. The sol solution was applied to the magnet produced in Example 1 and having the aluminum film of 0.05 μm on its surface at a pulling rate shown in Table 7 by a dip coating process, and then subjected to a heat treatment shown in Table 7 to form a Si—Al composite oxide film on the aluminum film. The formed film ($SiO_x.Al_2O_y$ film:$0<x\leqq 2$ and $0<y\leqq 3$) had a thickness of 0.9 μm. The content of carbon (C) in the film was 290 ppm. The structure of the film was amorphous.

The magnet produced by the above-described process and having the Si—Al composite oxide film on its surface with the aluminum film interposed therebetween was subjected to a corrosion resistance acceleration test under the same conditions as in Example 1. The results are given in Table 8. As a result, it was found that the produced magnet satisfied the required corrosion resistance sufficiently. The magnet was further subjected to another test, i.e., a compressing-shearing test under the same conditions as in Example 1 to measure a shear bond strength of the magnet, thereby providing an excellent value of 323 kgf/cm$^2$.

TABLE 5

| | Si compound | Al compound | Catalyst | Stabilizer | Organic solvent |
|---|---|---|---|---|---|
| Example 5 | dimethyl-diethoxy silane | Si-Al composite alkoxide (Note.1) | hydrochloric acid | not added | ethanol |

(Note. 1) Compound represented by $(H_5C_2O)_3SiOAl(OC_2H_5)_2$

TABLE 6

| | Proportion* of metal compounds (% by weight) | Molar ratio Al/Si +Al | Catalyst/Metal compounds | water/Metal compounds | Viscosity (cP) | pH |
|---|---|---|---|---|---|---|
| Example 5 | 1 | 0.2 | 0.005 | 10 | 1.7 | 2.6 |

*in terms of $SiO_2 + Al_2O_3$

TABLE 7

| | Pulling rate (cm/min) | Heat treatment | Note |
|---|---|---|---|
| Example 5 | 5 | 100° C. × 10 min | Pulling-up and heat treatment were repeated five times |

TABLE 8

| | Before corrosion-resistance test | | | After corrosion-resistance test | | | |
|---|---|---|---|---|---|---|---|
| | Br (kG) | iHc (kOe) | (BH)max (MGOe) | Br (kG) | iHc (kOe) | (BH)max (MGOe) | Appearance after test |
| Example 5 | 11.4 | 16.6 | 30.6 | 11.4 | 16.3 | 29.8 | not varied |

Example 6

30 Magnet test pieces (having an apparent volume of 0.1 l and a weight of 0.32 kg) and short columnar Sn pieces having a diameter of 0.8 mm and a length of 1 mm (and having an apparent volume of 2 l and a weight of 11 kg) were thrown into a treating chamber having a volume of 3.5 l in a vibrating type barrel finishing machine (the total combined amount was 60% by volume of the internal volume of the treating chamber). They were then subjected to a dry treatment for 5 hours under conditions of vibration frequency of 60 Hz and an amplitude of 1.5 mm to form a Sn film on the surface of the magnet. The formed Sn film had a thickness of 0.4 $\mu$m.

A sol solution was prepared from the following components: a silicon (si) compound, a catalyst, a stabilizer, an organic solvent and water which are shown in Table 9, at a composition, a viscosity and a pH value which are shown in Table 10. The sol solution was applied to the magnet having the Sn film at a pulling rate shown in Table 11 by a dip coating process, and then subjected to a heat treatment shown in Table 11 to form a Si oxide film on the Sn film. The formed film ($SiO_x$ film:$0<x\leqq 2$) had a thickness of 0.3 $\mu$m. The content of carbon (C) in the film was 350 ppm. The structure of the film was amorphous.

The magnet produced by the above-described process and having the Si oxide film on its surface with the Sn film interposed therebetween was subjected to a corrosion resistance acceleration test under the same conditions as in Example 1. The results are given in Table 12. As a result, it was found that the produced magnet satisfied the required corrosion resistance sufficiently.

Example 7

150 Magnet test pieces (having an apparent volume of 0.5 l and a weight of 1.6 kg) and short columnar Zn pieces having a diameter of 1 mm and a length of 1 mm (and having an apparent volume of 20 1 and a weight of 100 kg) were thrown into a treating chamber having a volume of 50 l in a vibrating type barrel finishing machine (the total combined amount was 40% by volume of the internal volume of the treating chamber). They were then subjected to a dry treatment for 5 hours under conditions of vibration frequency of 60 Hz and an amplitude of 1.8 mm to form a Zn film on the surface of the magnet. The formed Zn film had a thickness of 0.2 $\mu$m.

A sol solution was prepared from the following components: a silicon (si) compound, a catalyst, a stabilizer, an organic solvent and water which are shown in Table 9, at a composition, a viscosity and a pH value which are shown in Table 10. The sol solution was applied to the magnet having the Zn film at a pulling rate shown in Table 11 by a dip coating process, and then subjected to a heat treatment shown in Table 11 to form a Si oxide film on the Zn film. The formed film ($SiO_x$ film:$0<x\leqq 2$) had a thickness of 0.7 $\mu$m. The content of carbon (C) in the film was 450 ppm. The structure of the film was amorphous.

The magnet produced by the above-described process and having the Si oxide film on its surface with the Zn film interposed therebetween was subjected to a corrosion resistance acceleration test under the same conditions as in Example 1. The results are given in Table 12. As a result, it was found that the produced magnet satisfied the required corrosion resistance sufficiently.

Example 8

A sol solution was prepared from the following components: a Zr compound, a catalyst, a stabilizer, an organic solvent and water which are shown in Table 9, at a composition, a viscosity and a pH value which are shown in Table 10. The sol solution was applied to the magnet produced in Example 7 and having the Zn film of 0.2 $\mu$m on its surface at a pulling rate shown in Table 11 by a dip coating process, and then subjected to a heat treatment shown in Table 11 to form a Zr oxide film on the Zn film. The formed film ($ZrO_x$ film:$0<x\leqq 2$) had a thickness of 0.6 $\mu$m. The content of carbon (C) in the film was 140 ppm. The structure of the film was amorphous.

The magnet produced by the above-described process and having the Zr oxide film on its surface with the Zn film interposed therebetween was subjected to a corrosion resistance acceleration test under the same conditions as in Example 1. The results are given in Table 12. As a result, it was found that the produced magnet satisfied the required corrosion resistance sufficiently.

TABLE 9

| | Metal compound | Catalyst | Stabilizer | Organic solvent |
|---|---|---|---|---|
| Example 6 | tetramethoxy silane | nitric acid | not added | Ethanol |
| Example 7 | dimetyldiethoxy silane | hydrochloric acid | not added | Ethanol |
| Example 8 | zirconium butoxide | acetic acid | ethyl acetoacetate | ethanol + isopropyl alcohol |

TABLE 10

| | Proportion of metal compound (% by weight) | Molar ratio Catalyst/Metal compound | Stabilizer/Metal compound | Water/Metal compound | Viscosity (cP) | pH |
|---|---|---|---|---|---|---|
| Example 6 | 10 (Note.1) | 0.001 | 0 | 1 | 1.8 | 3.2 |
| Example 7 | 1 (Note.1) | 0.005 | 0 | 20 | 1.5 | 2.3 |
| Example 8 | 5 (Note.2) | 2 | 1.5 | 1 | 1.7 | 3.8 |

(Note.1) in terms of $SiO_2$ (Note.2) in terms of $ZrO_2$

TABLE 11

| | Pulling rate (cm/min) | Heat treatment | Note |
|---|---|---|---|
| Example 6 | 10 | 100° C. × 20 min | |
| Example 7 | 5 | 150° C. × 10 min | Pulling-up and heat treatment were repeated five times |
| Example 8 | 5 | 350° C. × 20 min | Pulling-up and heat treatment were repeated five times |

TABLE 12

| | Before corrosion-resistance test | | | After corrosion-resistance test | | | |
|---|---|---|---|---|---|---|---|
| | Br (kG) | iHc (kOe) | (BH)max (MGOe) | Br (kG) | iHc (kOe) | (BH)max (MGOe) | Appearance after test |
| Example 6 | 11.4 | 16.4 | 30.4 | 11.3 | 16.3 | 29.8 | not varied |
| Example 7 | 11.3 | 16.5 | 30.5 | 11.3 | 16.4 | 29.9 | not varied |
| Example 8 | 11.4 | 16.5 | 30.6 | 11.3 | 16.4 | 29.8 | not varied |

What is claimed is:

1. A process for producing a permanent magnet having a film of a first metal provided on a surface thereof, and a film of oxide of a second metal provided on the film of the first metal, comprising the steps of:

placing into a treating vessel an Fe—B—R based permanent magnet, wherein R is a rare earth metal, and pieces of the first metal;

vibrating and/or agitating the magnet and the pieces of the first metal in the treating vessel, thereby forming on the surface of the magnet a film of a fine powder of the first metal produced from said pieces of the first metal;

applying to the surface of the film of the fine powder of the first metal a sol solution produced by hydrolysis of a compound of the second metal, wherein said compound is a staring material for a film of oxide of the second metal;

and subjecting the applied sol solution to a heat treatment whereby a film of oxide of the second metal is formed on the film of the first metal.

2. A process according to claim 1, wherein the first metal is at least one member selected from the group consisting of Al, Sn and Zn.

3. A process according to claim 1, wherein said metal pieces are of an acicular or columnar shape with a length of 0.05 mm to 10 mm.

4. A process according to claim 1, wherein the thickness of the film of the first metal is in a range of 0.01 $\mu$m to 1 $\mu$m.

5. A process according to claim 1, wherein the second metal is at least one selected from the group consisting of Al, Si, Zr and Ti.

6. A process according to claim 1, wherein the second metal is the same as the first metal.

7. A process according to claim 1, wherein the thickness of the film of oxide of the second metal is in a range of 0.01 $\mu$m to 10 $\mu$m.

8. A process according to claim 1, wherein the film of oxide of the second metal has a carbon content in a range of 50 ppm to 1,000 ppm.

9. A process according to claim 1 wherein the film of oxide of the second metal consists essentially of an amorphous phase.

* * * * *